US006442921B2

(12) United States Patent
Feeley

(10) Patent No.: US 6,442,921 B2
(45) Date of Patent: Sep. 3, 2002

(54) METHOD OF RAKING WITH A TRACTOR HAVING A REAR HYDRAULIC BLADE

(76) Inventor: Eamon E. Feeley, 3645 Indianpipe Cir., Colorado Springs, CO (US) 80918

( * ) Notice: Subject to any disclaimer, the term of this patent is extended or adjusted under 35 U.S.C. 154(b) by 0 days.

(21) Appl. No.: 09/444,662

(22) Filed: Nov. 22, 1999

(51) Int. Cl.[7] ..... A01D 7/00

(52) U.S. Cl. ..... 56/400.07; 56/400.05; 56/DIG. 21; 37/405

(58) Field of Search ..... 56/400.01, 400.04, 56/400.05, 400.07, 400.14, 400.16, 400.21, DIG. 21; 37/403–410, 903, 466

(56) References Cited

U.S. PATENT DOCUMENTS

| | | | | | |
|---|---|---|---|---|---|
| 531,722 | A | * | 1/1895 | Keigley | 37/405 |
| 928,336 | A | * | 7/1909 | Sargent | 56/400.21 |
| 2,632,261 | A | * | 3/1953 | Ferris, Jr. | 37/405 |
| 3,163,945 | A | * | 1/1965 | Dooley | 37/405 |
| 4,242,035 | A | * | 12/1980 | Hornstein | 414/724 |
| 4,304,307 | A | * | 12/1981 | Anderson | 172/791 |
| 4,651,450 | A | * | 3/1987 | York et al. | 37/405 |
| 5,425,189 | A | * | 6/1995 | Anderson et al. | 37/405 |
| 5,515,625 | A | * | 5/1996 | Keigley | 37/405 |

* cited by examiner

*Primary Examiner*—Thomas B. Will
*Assistant Examiner*—Meredith Petravick
(74) *Attorney, Agent, or Firm*—G. F. Gallinger

(57) ABSTRACT

A method of raking with a tractor having a rear horizontally elongated hydraulic blade. After attachment the rake can be can be lifted, lowered, and pressed down into the soil or gravel etc. being raked with hydraulic power. The method comprises the following steps: providing a horizontally elongate member adapted to be carried adjacent, parallel to, and beneath the bottom portion of the blade, said member having teeth spaced along and extending downwardly therefrom; providing blade attachment devices affixed along the elongate member for releasably attaching the member beneath the bottom portion of the blade; and, releasably attaching the elongate member to the blade on the tractor. In a preferred embodiment of this invention the elongated member comprises a channel, the blade attachment devices comprise arms which extend from opposite side portions of the channel and surround the blade, and the teeth comprise hardened replaceable bolts.

18 Claims, 1 Drawing Sheet

METHOD OF RAKING WITH A TRACTOR HAVING A REAR HYDRAULIC BLADE

FIELD OF INVENTION

This invention relates to rakes used on tractors. More particularly this invention relates to a method of raking by adapting a rear hydraulic blade on a tractor.

BACKGROUND OF THE INVENTION

Tractors and other vehicles are frequently equipped with a hydraulic blade. The hydraulic blade can be lifted, lowered, and pressed down with hydraulic power. Generally the need for a rake is not as great as a blade and many tractors on which a rake could be used to advantage, already have a blade.

There is a need for a rake attachment for a blade on a tractor. Compared to the cost of a rake attachment for a tractor, the cost of a rake attachment to a blade is minimal. The blade itself can be used for support of the rake. Once a rake is attached to the blade the hydraulic controls of the blade can operate the rake. Installation onto a blade is quicker and easier than removing the blade and installing an entire rake to the tractor. The space required for storage of a blade attachment is a fraction of the space required for an entire rake. There is a real need for an inexpensive rake attachment for a tractor blade.

OBJECTS AND STATEMENT OF INVENTION

It is an object of this invention to disclose a method of raking with a tractor having a rear hydraulic blade. It is yet a further object of this invention to disclose an inexpensive and effective hydraulically controlled rake for a tractor having a blade. It is a further object of this invention to disclose a rake attachment for a tractor that will minimize storage space requirements.

One aspect of this invention provides for a method of raking with a tractor having a rear horizontally elongated hydraulic blade comprising the following steps: providing a horizontally elongate member adapted to be carried adjacent, parallel to, and beneath the bottom portion of the blade, said member having teeth spaced along and extending downwardly therefrom; providing blade attachment means affixed along the elongate member for releasably attaching the member beneath the bottom portion of the blade; and, releasably attaching the elongate member to the blade on the tractor. The rake attachment can not only be dragged behind the tractor like most rakes; but additionally, it can be pressed downwardly with the hydraulic mechanism on the blade.

In a preferred embodiment of this invention the elongated member comprises a channel, the blade attachment means comprises arms which extend from opposite side portions of the channel and surround the blade, and the teeth comprise hardened replaceable bolts.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
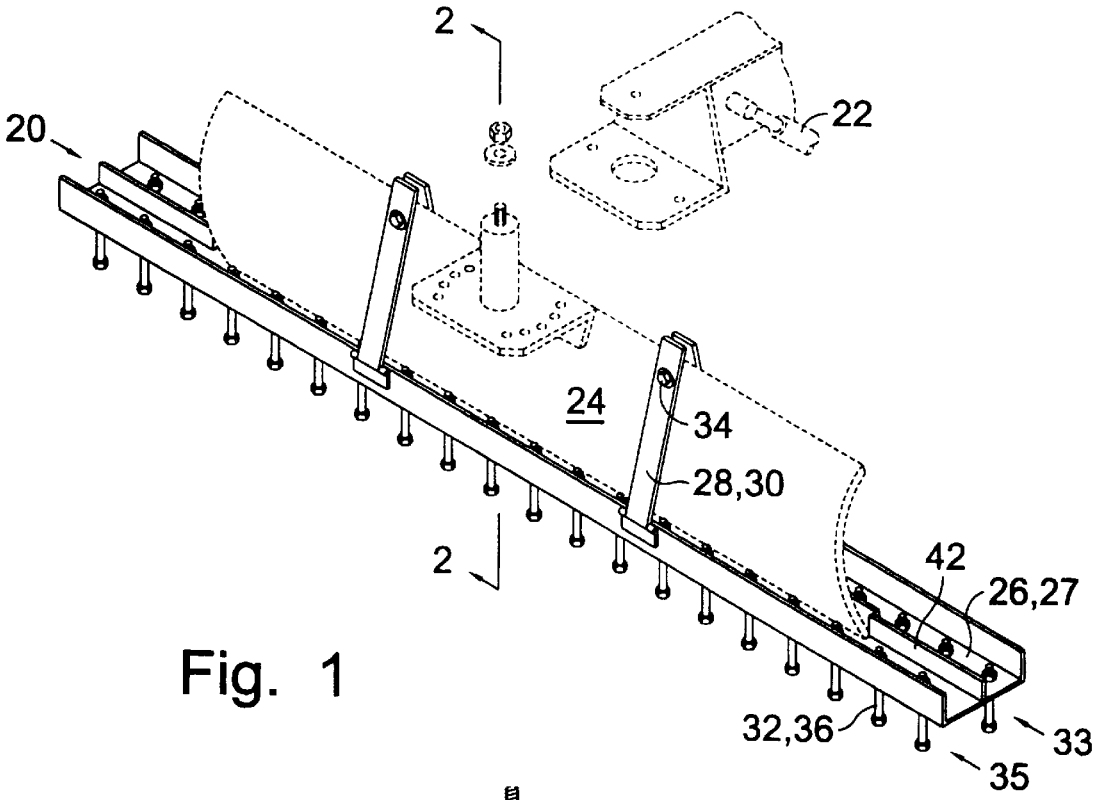
FIG. 1 is a perspective view of a rake for attachment to a blade mounted on a tractor.
Figure 2:
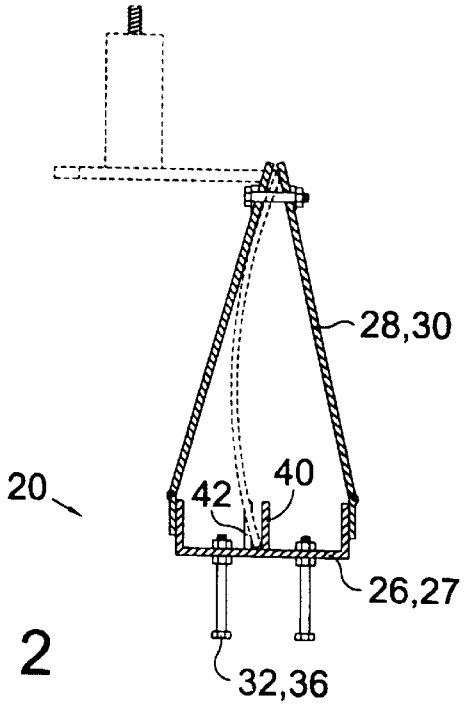
FIG. 2 is a cross sectional view of the rake as viewed along line 2—2 on FIG. 1.

The following is a discussion and description of the preferred specific embodiments of this invention, such being made with reference to the drawings, wherein the same reference numerals are used to indicate the same or similar parts and/ or structure. It should be noted that such discussion and description is not meant to unduly limit the scope of the invention.

DESCRIPTION OF THE INVENTION

Turning now to the drawings and more particularly to FIG. 1 we have a perspective view of a rake 20 for attachment to a hydraulically 22 controlled blade 24 on a tractor (not shown). The rake 20 for attachment to a horizontally elongated blade 24 comprises: a horizontally elongated member 26 adapted to be carried adjacent, parallel to, and beneath the bottom portion of the blade 24; blade attachment means 28 affixed along the elongate member 26 for releasably attaching the member 26 beneath the bottom portion of the blade 24; and, teeth 32 spaced along and extending downwardly beneath the elongate member 26.

Most preferably the elongate member 26 comprises a channel 27. Most preferably the attachment means 28 comprise two upright arms 30, one extending from a front side portion of the elongate member 26, and one extending from a rear opposite side portion of the elongate member 26 so that when the blade 24 is seated on the elongate member 26 a top portion of the arms 30 may be held together around the blade 24. Most preferably the arms 30 are adapted to be held together by a bolt 34 extending there through the arms 30 and the blade 24. Blade bottom portion position guides 40, 42 are welded respectively in front of 40 and on opposite ends 42 of the channel 27 to maintain the blade bottom portion centrally on the channel 27.

Most preferably there are two parallel rows of teeth 32, one row 33 of teeth 32 extends downwardly from a front portion of the channel 26, and the other row of teeth 35 extends downwardly from a rear portion of the channel 26. The teeth 32 in the front row 33 are staggered from the teeth 32 in the rear row 35 so that the ground (not shown) will be raked more finely.

Most preferably the teeth 32 have a threaded top portion so that they may be easily replaced when worn. In the most preferred embodiment of the invention the teeth 32 comprise hardened replaceable bolts 36. If it is desired the heads of the bolts 36 may be ground off to a point. (not shown) In the most preferred embodiment of the invention the channel is 8" wide by 8' long. In the most preferred embodiment of the invention the arms 30 are made from flat bar.

In use the rake 20 is positioned parallel to and centered under the blade 24. The blade 24 is hydraulically lowered and seated thereon. The arms 30, now surrounding the blade 24 are then bolted together through the blade 24. The rake 20 then can be carried with the blade 24 on the tractor (not shown). In operation the rake 20 can be hydraulically lowered and pressed into the ground, gravel, etc. (none shown) being raked.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A method of raking with a small tractor having a blade dragged therebehind comprising the following steps:

providing an elongate blade seating member, having a length substantially at least as long as the blade on the tractor, and adapted to be carried directly adjacent, parallel to, and beneath the bottom cutting portion of the blade, said member having teeth spaced along, individually attached thereto, and extending downwardly therefrom;

providing pairs of spaced opposite upright straps, each strap having a lower and an upper portion, and each pair of straps having a front strap having a lower portion attached to a front side portion of the blade seating member, and a rear strap having a lower portion attached to a rear side portion of the blade seating member, so that together the front and rear straps extend upwardly around the blade;

providing a releasable attachment means having two aligned holes each extending through, the upper portion of the opposite straps and a bore aligned with the holes extending through a central portion of the blade;

positioning the upper portions of the front and rear straps around the blade so that the holes and bore are in alignment; and, attaching said front and rear straps together by a member extending through the holes and bore, said blade seating member thereby secured by the straps beneath the blade;

so that the spaced teeth can be dragged behind the tractor and pressed downwardly with the hydraulic mechanism on the blade.

2. A method of raking as in claim 1 wherein the blade seating member comprises a channel.

3. A method of raking as in claim 2 wherein the length of the channel substantially exceeds the length of the blade.

4. A method of raking as in claim 3 wherein the rake is secured to the blade by and only by the straps and releasable attachment means.

5. A method of raking as in claim 4 wherein the member extending through the hole comprises a bolt which is held in position by a nut.

6. A method of raking as in claim 5 wherein the straps comprise strips of flexible metal so that they may first spring apart from one another to accept insertion of the blade therebetween, and subsequently may spring together to be tightly bolted with the bolt extending through and between upper portions of the straps and through the bore in the blade.

7. A method of raking as in claim 6 wherein there are two and only two pairs of upright straps, each pair of straps extending upwardly from an opposite end portion of the blade.

8. A method of raking as in claim 7 wherein the channel has a front, center, and rear web portion, each of which extend upwardly; and further comprising the steps of positioning a bottom cutting portion of the blade directly adjacent to a back side portion of the center web; providing a front row of laterally spaced teeth extending downwardly from between the front and center webs; and a rear row of teeth, laterally shifted from the front row of teeth to rake between the teeth in the front row, and extending downwardly from between the center and rear webs.

9. A rake method of raking as in claim 8 wherein the teeth comprise replaceable bolts.

10. A rake attachment for a tractor having a horizontally elongate blade comprising:

an elongate blade seating member having a length at least substantially as long as the blade on the tractor, and adapted to be carried directly adjacent, parallel to, and beneath the bottom cutting portion of the blade;

teeth spaced along, individually rigidly attached to, and extending downwardly beneath the elongate member;

pairs of spaced opposite upright straps, each strap having a lower and an upper portion, and each pair of straps having a front strap having a lower portion attached to a front side portion of the blade seating member, and a rear strap having a lower portion attached to a rear side portion of the blade seating member, so that together the front and rear straps extend upwardly around the blade;

a releasable attachment means having two aligned holes extending through the upper portion of the opposite straps, and a bore aligned with the holes extending through a central portion of the blade, and wherein said front and rear straps are attached together by a member extending through the holes and bore; and, a member extending through the holes and bore for releasably attaching the upper portions of front and rear straps together around the blade, said rake attachment thereby secured to and beneath the blade.

11. A rake as in claim 10 wherein the horizontally elongate member comprises a channel.

12. A rake as in claim 11 wherein the length of the channel exceeds the length of the blade.

13. A rake as in claim 12 wherein the rake is secured to the blade by and only by the straps and releasable attachment means.

14. A rake as in claim 13 wherein the member extending through the hole comprises a bolt which is held in position by a nut.

15. A rake as in claim 14 wherein the straps comprise strips of flexible metal so that they may first spring apart from one another to accept insertion of the blade therebetween, and subsequently may spring together to be tightly bolted with the bolt extending through and between upper portions of the straps and, through the bore in the blade.

16. A rake as in claim 15 wherein there are two and only two pairs of upright straps each pair of straps extending upwardly from an opposite end portion of the blade.

17. A rake as in claim 14 wherein the channel has a front row and a rear row of laterally spaced teeth, each of the teeth in the rear row laterally moved to rake in between the teeth in the front row; and wherein a bottom cutting portion of the blade is positioned directly adjacent to a back side portion of the center web.

18. A rake as in claim 17 wherein the teeth comprise replaceable bolts.

* * * * *